United States Patent [19]

Straitz, III

[11] 4,038,024

[45] July 26, 1977

[54] FLARE STACK GAS BURNER

[75] Inventor: John F. Straitz, III, Meadowbrook, Pa.

[73] Assignee: Combustion Unlimited Incorporated, Elkins Park, Pa.

[21] Appl. No.: 637,385

[22] Filed: Dec. 3, 1975

[51] Int. Cl.[2] ..... F23C 11/00

[52] U.S. Cl. ..... 431/202; 239/403; 239/565; 239/568

[58] Field of Search ..... 239/565, 598, 568, 403; 431/202, 285

[56] References Cited

U.S. PATENT DOCUMENTS

| | | | |
|---|---|---|---|
| 3,164,200 | 1/1965 | Reed | 239/403 X |
| 3,730,673 | 5/1973 | Straitz | 431/202 X |
| 3,797,991 | 3/1974 | Straitz | 431/202 |
| 3,822,984 | 7/1974 | Straitz | 431/202 X |
| 3,822,985 | 7/1974 | Straitz | 431/202 X |
| 3,824,073 | 7/1974 | Straitz | 431/202 X |
| 3,904,127 | 9/1975 | Cash | 239/568 X |

*Primary Examiner*—Alan Cohan
*Assistant Examiner*—Gerald A. Michalsky
*Attorney, Agent, or Firm*—Zachary T. Wobensmith, 2nd; Zachary T. Wobensmith, III

[57] ABSTRACT

A flare stack gas burner for waste combustible gas from oil refineries, chemical plants, oil production rigs, LPG and other marketing terminals, pipe lines and the like is disclosed which includes a stack providing a combustible gas delivery pipe with a plurality of outwardly extending hollow vanes at the top with fixed inclined nozzles along the tops of the vanes for discharge of the combustible gas in a plurality of flat inclined streams at an inclination of the order of 45° from the horizontal in a hollow frustoconical vortex combustion path, the inclined streams inducing air on each face and into the vortex path and around the exterior for completing combustion. The effective contact of the air and mixing of the air with the combustible gas and burning gas provides smokeless combustion. A vent seal is provided to prevent entry of air into the stack.

3 Claims, 4 Drawing Figures

FLARE STACK GAS BURNER

BACKGROUND OF THE INVENTION

1. Field of the Invention

This invention relates to flare stack gas burners for combustible waste gas from various sources and for smokeless burning without steam.

2. Description of the Prior Art

In industrial operations and particularly in the operation of oil refineries, chemical plants, oil production rigs, LPG and other marketing terminals, pipe lines and other combustible waste gas sources it becomes necessary from time to time to burn various quantities of combustible gaseous materials with the combustion carried out without discharge of unburned carbon particles in the form of smoke into the atmosphere.

Various flare stack gas burners have heretofore been proposed for the combustion of waste gas but many of these had serious limitations, particularly because of inadequate turbulence and mixing of combustible and burning gases with air to operate smokelessly.

In addition, at some locations, no adequate supply of steam is available for smoke suppression as has been used in many flare stack burners. Other considerations, such as climate, may also preclude the use of steam for smoke suppression.

Among the burners which require steam to induce air for contact with the burning gases are those shown in the U.S. Pat. Nos. to Verner, et al., 2,761,496, Webster, et. al., 2,891,607, Shellentrager, 2,506,972, Zink, et al, 2,779,399, Campbell, et al., 2,802,521, Zink, et al., 3,143,424, Zink, et al., 3,539,285, Turpin, 3,547,567, Proctor, 3,554,681, Zink, et al., 3,697,231, and Abernathy, et. al., 3,864,072.

It has heretofore been proposed in gas fired burners to provide radial arms with gas jets to give a radial flame pattern, one illustration being shown in the Reed U.S. Pat. No. 2,826,603, but these burners were not suitable for nor intended to be used as flare stacks and do not provide adequate turbulence at the location of gas discharge and combustion.

In my prior U.S. Pat. Nos. 3,797,991, 3,822,984, 3,822,985 and 3,824,073, vanes with gas delivery slots are shown but these were not positioned to bring about the desired flame to air interface, air and gas admixing and air to burning gas turbulence, and in U.S. Pat. Nos. 3,797,991, 3,703,673, and 3,822,984 steam was employed to aid in the intermixing of air for completion of combustion without smoke.

SUMMARY OF THE INVENTION

In accordance with the invention a flare stack gas burner is provided suitable for the burning of combustible waste gas from a variety of sources which includes a stack providing a gas delivery pipe having horizontal outwardly extending hollow vanes or arms with fixed inclined nozzles along the top for discharge of the combustible gas in a plurality of flat upwardly inclined streams in a hollow cylindrical or flaring frustoconical vortex, the inclined streams inducing air on each face and around the exterior for completing combustion free from smoke.

It is the principal object of the invention to provide a flare stack gas burner which is effective for the combustion of waste combustible gases free from smoke and without the necessity for employing steam.

It is a further object of the invention to provide a flare stack gas burner in which the combustible waste gas is delivered at the top of the stack and admixed with air in an improved maner and without the use of steam for smokeless combustion.

It is a further object of the invention to provide a flare stack gas burner in which the combustion is effected in an ascending cylindrical or flaring frusto-conical vortex with adequate air induced thereinto to avoid smoke formation.

It is a further object of the invention to provide a flare stack gas burner of the character aforesaid in which the component parts are simple, sturdy, trouble free, require a minimum of maintenance, and which is more effective in its burning of the waste gas than the flare burners heretofore available.

Other objects and advantageous features of the invention will be apparent from the description and claims.

BRIEF DESCRIPTION OF THE DRAWINGS

The nature and characteristic features of the invention will be readily understood from the following description taken in connection with the accompanying drawings forming part hereof, in which.

Figure 1:
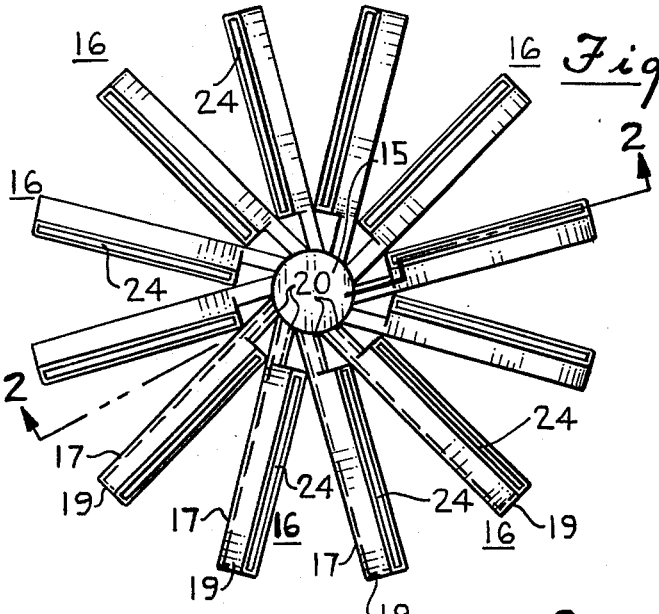
FIG. 1 is a top plan view of the flare stack gas burner in accordance with the invention.
Figure 2:
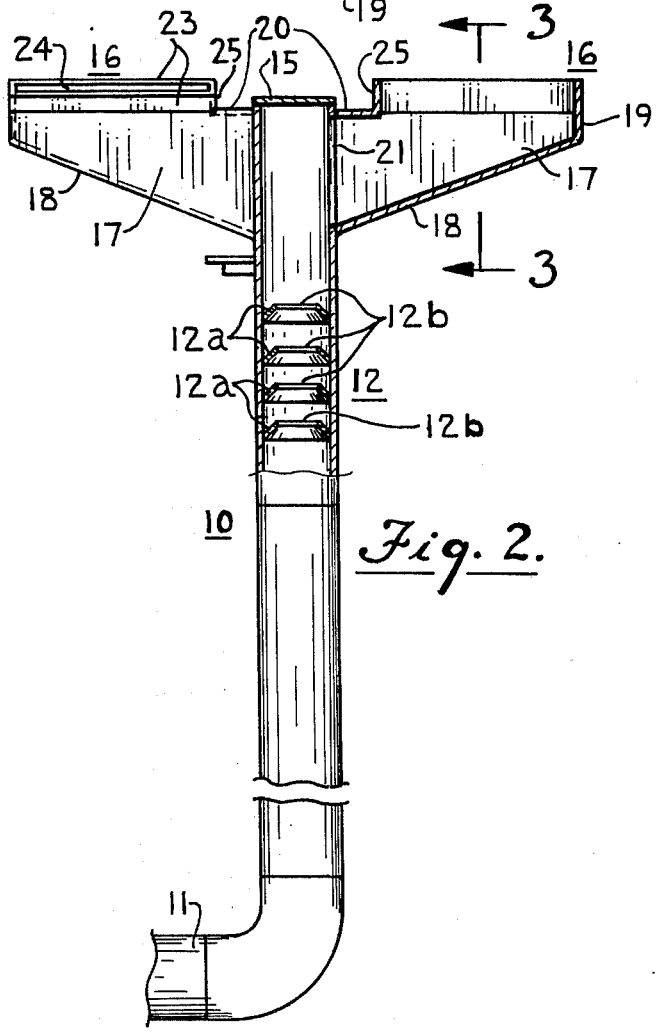
FIG. 2 is a view partly in elevation and partly in vertical section taken approximately on the line 2—2 of FIG. 1.
Figure 3:
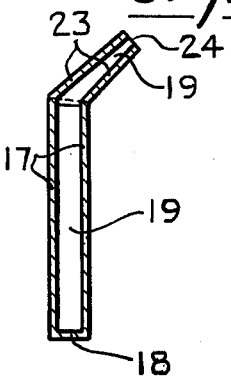
FIG. 3 is a vertical sectional view, enlarged, taken approximately on the line 3—3 of FIG. 2.
Figure 4:
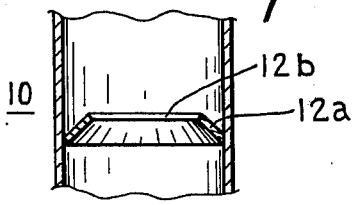
FIG. 4 is a fragmentary vertical sectional view of a portion of the stack showing one of the vent seal elements.

It should, of course, be understood that the description and drawings herein are illustrative merely and that various modifications and changes can be made in the structure disclosed without departing from the spirit of the invention.

DESCRIPTION OF THE PREFERRED EMBODIMENT

Referring now more particularly to the drawings, a vertical stack pipe 10 is shown, circular in horizontal cross section and supported in any desired manner and has a pipe 11 connected thereto for the supplying of the waste combustible gas.

The pipe 10 is preferably fabricated of steel and coated to reduce rusting, and in a specific embodiment may be of a height of the order of seven feet and an outside diameter of the order of thirteen inches.

The pipe 10, intermediate the top and bottom thereof, and to prevent downflow in the interior of the pipe 10, whether by external wind conditions or contraction by cooling of hot gas in the system, and also to reduce fluid oscillations, is provided with a fluidic diode 12, such as that shown in my prior U.S. Pat. No. 3,730,673 and 3,797,991.

The fluidic diode 12 preferably comprises a plurality of frustoconical baffles 12a of metal or other material which is not adversely affected by the elevated temperature of the combustible gas which may be of the order of 400° to 700° Fahrenheit. The baffles **12*a* terminate at their peripheries at the pipe 10 and have aligned central openings 12*b***.

The stack pipe 10 is closed at its upper end by a cover plate 15 secured in place.

A plurality of vanes 16 are provided secured to and extending outwardly from the pipe 10 at the top thereof and tangential to a circle within the pipe 10 and of smaller diameter than the pipe 10.

Each of the vanes 16 has spaced parallel vertical side walls 17, an outwardly extending upwardly inclined bottom wall 18, an outer vertical end wall 19 and an inner short horizontal connecting wall 20. The interiors of the vanes 16 are in communication with the interior of the pipe 10 through vertical openings 21 in the pipe 10.

The upper horizontal margins of the walls 17 have converging plates 23 secured thereto to provide inclined nozzles with elongated nozzle openings 24. The central longitudinal axial plane of the nozzles is preferably at about 45° from the horizontal. The outer ends of the nozzle wall plates 23 are closed by upper extensions of the outer end walls 19 and the inner ends by inner end walls 25.

In a specific embodiment the vanes can be of a total length of the order three feet, and the nozzle slots or openings 24 can be of the order of thirteen sixty fourths of an inch.

An igniter of conventional type (not shown) can be employed to initiate combustion of the combustible gas upon its discharge from the nozzle openings 24.

The manner of use will now be pointed out.

Combustible waste gas to be burned is supplied under pressure through the supply pipe 11 and upwardly through the pipe 10. The gas under pressure passes outwardly through the openings 21 in the pipe 10 and into the vanes 16. The gas in the interior of the vanes 16 is delivered between the inclined converging plates 23 and is discharged through the nozzle openings 24 in a plurality of flat upwardly inclined streams, one from each vane, in a hollow cylindrical or flaring frustoconical vortex. The upward velocity component of the gas induces air from below upwardly along the side walls 17 and then along the inclined converging walls 23 directed in the same directions as the streams of combustible gas where it is drawn along both side faces of the gas stream from the nozzle openings 24 to support combustion. The induced air streams also tend to mix with the gas streams and with the swirling burning gas in its upward movement.

Since no air or steam is employed either to impel the combustible gas or the air to support combustion the projection of the gas from the nozzle openings 24 is preferably at a relatively flat angle, and preferably not in excess of 45° to obtain the desired induction of air by the gas and mixing of the air with the gas and with the burning gas to obtain complete and rapid combustion without release of unburned carbon particles.

I claim:

1. A flare stack gas burner for waste combustible gas comprising a vertical stack pipe closed at the top and with an outwardly extending wall to which combustible gas is supplied for combustion, a plurality of hollow fixed vanes extending outwardly from said outwardly extending wall and said stack pipe and to the interiors of which the gas from said stack is delivered, each of said vanes having spaced parallel vertical side walls connected at the bottom by an upwardly and outwardly inclined bottom wall, and said vanes being of a length of a plurality of times the diameter of the stack pipe, and means for inducing the air required for the combustion of said gas comprising a plurality of elongated flat inclined nozzles extending from said vanes for gas to be burned with at least one nozzle for each vane and to which said gas is delivered, said nozzles extending substantially the lengths of the vanes, and said nozzles having interior walls extending from the vertical side walls and converging to provide nozzle discharge openings and inducing combustion supporting air between said vanes and on each side of the gas streams discharged from said nozzles.

2. A flare stack gas burner as defined in claim 1 in which said vanes extend outwardly tangentially to a circle concentric with the center of the vertical stack pipe.

3. A flare stack gas burner as defined in claim 1 in which back flow preventing members are provided in said vertical stack below said vanes.

* * * * *